US006397882B1

(12) United States Patent
Anderson

(10) Patent No.: US 6,397,882 B1
(45) Date of Patent: Jun. 4, 2002

(54) PRESSURE VACUUM BREAKER COVER ASSEMBLY

(76) Inventor: David C. Anderson, 9940 E. Costilla Ave., Unit O, Englewood, CO (US) 80112

( * ) Notice: Subject to any disclaimer, the term of this patent is extended or adjusted under 35 U.S.C. 154(b) by 0 days.

(21) Appl. No.: 09/795,035

(22) Filed: Feb. 26, 2001

(51) Int. Cl.[7] ..... E03C 1/10
(52) U.S. Cl. ..... 137/375; 137/382
(58) Field of Search ..... 137/375, 382, 137/377

(56) References Cited

U.S. PATENT DOCUMENTS 3,044,915 A * 7/1962 Jacobsen ..... 137/375
4,830,060 A * 5/1989 Botsolas ..... 137/375
5,540,255 A * 7/1996 Trueb et al. ..... 137/375
5,836,345 A * 11/1998 Ericson ..... 137/382

* cited by examiner

*Primary Examiner*—A. Michael Chambers

(57) ABSTRACT

A pressure vacuum breaker cover assembly for protecting a vacuum breaker while simultaneously improving the appearance. The inventive device includes a pair of covers having a shell structure attachable to one another about a vacuum breaker. Each of the covers includes a lip that mates with the opposing cover lip, a plurality of apertures that allow the securing of the covers together with a conventional fastener, a lower cutout for receiving a lower pipe, and a side cutout for receiving an upper pipe from the vacuum breaker. The covers are preferably constructed of a STYROFOAM or polyfoam material for insulating and protecting the vacuum breaker and pipes. The exterior surface of the covers may be painted to match the exterior of the building structure.

6 Claims, 5 Drawing Sheets

PRESSURE VACUUM BREAKER COVER ASSEMBLY

BACKGROUND OF THE INVENTION

1. Field of the Invention

The present invention relates generally to cover devices and more specifically it relates to a pressure vacuum breaker cover assembly for protecting a vacuum breaker while simultaneously improving the overall appearance thereof.

Conventional vacuum breakers are utilized to provide a means for relieving or breaking a vacuum within a pipe which are often times positioned above a ground surface adjacent a building structure. Vacuum breakers are commonly utilized within underground sprinkler systems where the height of the vacuum breaker is typically at least 12 inches above the highest sprinkler head or outlet. Vacuum breakers are also utilized upon various other devices and systems as is well-known in the art.

Vacuum breakers have one or more air vents that manufacturers expressly advise consumers not to obstruct or block. Because these vacuum breakers are above the ground surface, they are extremely susceptible to damage from vehicles and debris. Vacuum breakers can also be undesirable for the overall aesthetics of an individual's yard. In addition, vacuum breakers often times corrode causing an undesirable sight for visitors and the homeowner. Hence, there is a need for a cover system that simultaneously protects the vacuum breaker while also improving the overall appearance of the valve.

2. Description of the Prior Art

Examples of cover devices include U.S. Design Patent No. D293,703 to Kaye; U.S. Pat. No. 4,556,082 to Riley et al.; U.S. Pat. No. 5,797,415 to Nicholson et al.; U.S. Design Patent No. D300,555 to Patterson; U.S. Pat. No. 5,713,394 to Nygaard; and U.S. Pat. No. 4,830,060 to Botsolas are all illustrative of such prior art.

Kaye (U.S. Pat. No. 293,703) discloses a removable insulated valve cover. Kaye teaches a cover having a lace for attachment about a valve while allowing the valve handle to be accessed.

Riley et al. (U.S. Pat. No. 4,556,082) discloses a removable thermal insulation jacket for valves and fittings. Kaye teaches a unitary jacket that is attachable about valves and pipefittings by attached draw cords.

Nicholson et al. (U.S. Pat. No. 5,797,415) discloses an insulating jacket for hot and cold piping systems. Nicholson teaches a jacket made of a plurality of sections which mate and seal together to effectively seal the valve off from the surrounding ambient atmosphere.

While these devices may be suitable for the particular purpose to which they address, they are not as suitable for protecting a vacuum breaker while simultaneously improving the appearance. Conventional valve cover devices do not provide a desirable uniform appearance to the exterior of the valve. In addition, conventional valve cover devices are not easily attachable to a vacuum breaker or allow the vacuum breaker to breath.

In these respects, the pressure vacuum breaker cover assembly according to the present invention substantially departs from the conventional concepts and designs of the prior art, and in so doing provides an apparatus primarily developed for the purpose of protecting a vacuum breaker while simultaneously improving the appearance.

SUMMARY OF THE INVENTION

In view of the foregoing disadvantages inherent in the known types of cover devices now present in the prior art, the present invention provides a new pressure vacuum breaker cover assembly construction wherein the same can be utilized for protecting a vacuum breaker while simultaneously improving the appearance.

The general purpose of the present invention, which will be described subsequently in greater detail, is to provide a new pressure vacuum breaker cover assembly that has many of the advantages of the cover devices mentioned heretofore and many novel features that result in a new pressure vacuum breaker cover assembly which is not anticipated, rendered obvious, suggested, or even implied by any of the prior art cover devices, either alone or in any combination thereof.

To attain this, the present invention generally comprises a pair of covers having a shell structure attachable to one another about a vacuum breaker. Each of the covers includes a lip that mates with the opposing cover lip, a plurality of apertures that allow the securing of the covers together with a conventional fastener, a lower cutout for receiving a lower pipe, and a side cutout for receiving an upper pipe from the vacuum breaker. The covers are preferably constructed of a Styrofoam or polyfoam material for insulating and protecting the vacuum breaker and pipes. The exterior surface of the covers may be painted to match the exterior of the building structure.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a pressure vacuum breaker cover assembly that will overcome the shortcomings of the prior art devices.

Another object is to provide a pressure vacuum breaker cover assembly that increases the appearance of a pressure vacuum breaker.

An additional object is to provide a pressure vacuum breaker cover assembly that prevents a pressure vacuum breaker from becoming damaged.

A further object is to provide a pressure vacuum breaker cover assembly that adds thermal insulation to a pressure vacuum breaker.

Another object is to provide a pressure vacuum breaker cover assembly that is easily attached and removed from a conventional pressure vacuum breaker.

Another object is to provide a pressure vacuum breaker cover assembly that is shock absorbent.

A further object is to provide a pressure vacuum breaker cover assembly that allows the pressure vacuum breaker to be utilized with the cover attached.

Another object is to provide a pressure vacuum breaker cover assembly that allows the user to easily access the pressure vacuum breaker.

An additional object is to provide a pressure vacuum breaker cover assembly that may be painted to match the exterior of an adjacent building structure.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
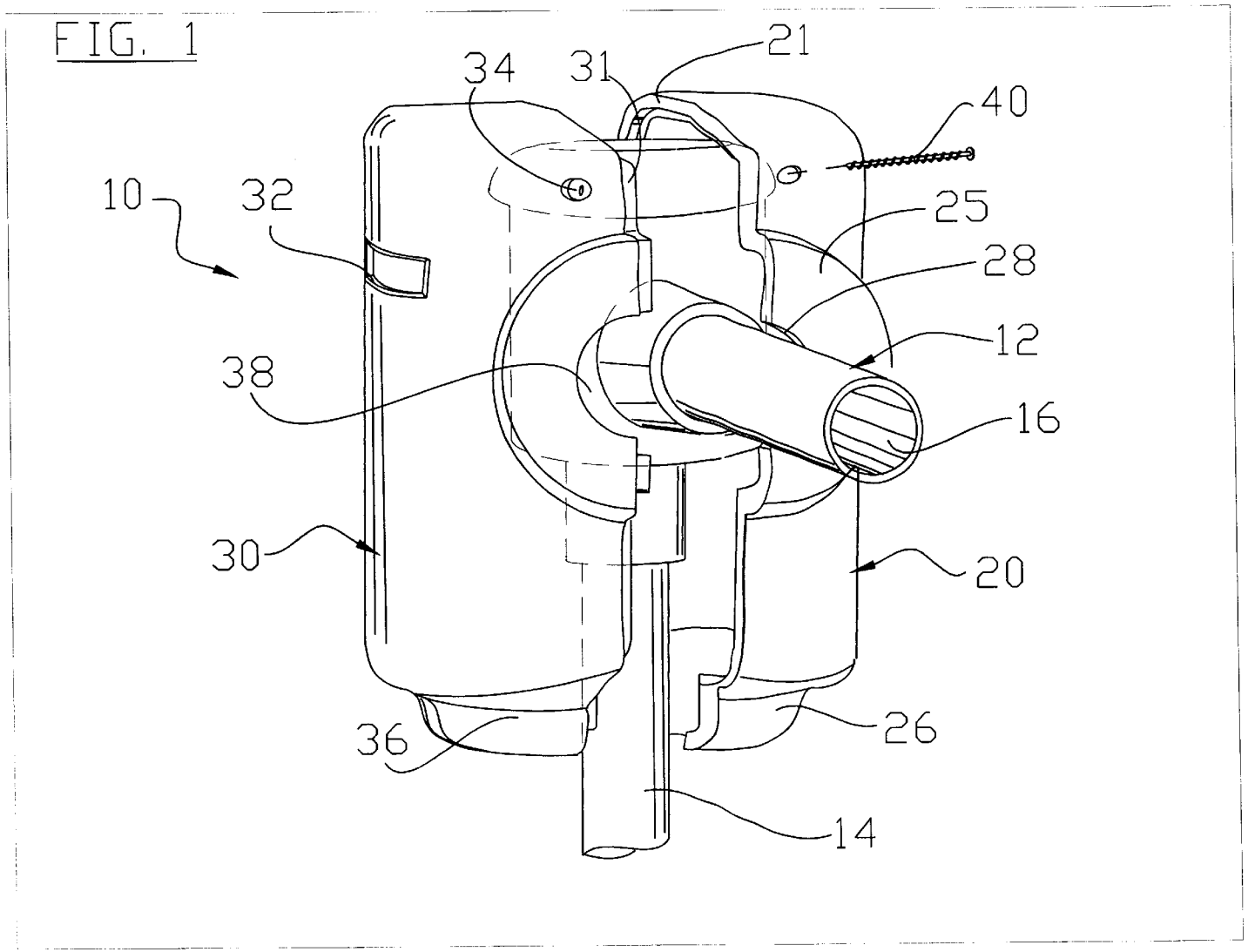
FIG. 1 is an exploded upper perspective view of the present invention positioned about a pressure vacuum breaker.

Turning now descriptively to the drawings, in which similar reference characters denote similar elements throughout the several view, FIGS. 1 through 5 illustrate a pressure vacuum breaker cover assembly 10, which comprises a pair of covers 20, 30 having a shell structure attachable to one another about a vacuum breaker 12. Each of the covers 20, 30 includes a lip 21, 31 that mates with the opposing cover 20, 30 lip, a plurality of apertures 24, 34 that allow the securing of the covers 20, 30 together with a conventional fastener 40, a lower cutout 29, 39 for receiving a lower pipe 14, and a side cutout 28, 38 for receiving an upper pipe 16 from the vacuum breaker 12. The covers 20, 30 are preferably constructed of a STYROFOAM or polyfoam material for insulating and protecting the vacuum breaker 12 and pipes. The exterior surface of the covers 20, 30 may be painted to match the exterior of the building structure.

As best shown in FIG. 1 of the drawings, the first cover 20 is formed into a shell structure for conforming to half of the shape of the vacuum breaker 12. The first cover 20 has a first lip 21 that mates with the second lip 31 of the second cover 30 as shown in FIG. 1 of the drawings. The first cover 20 further includes at least one first vent 22 for allowing the vacuum breaker 12 to properly function and breath. The first vent 22 is preferably positioned within an upper portion of the first cover 20 on the side portion thereof.

Figure 4:
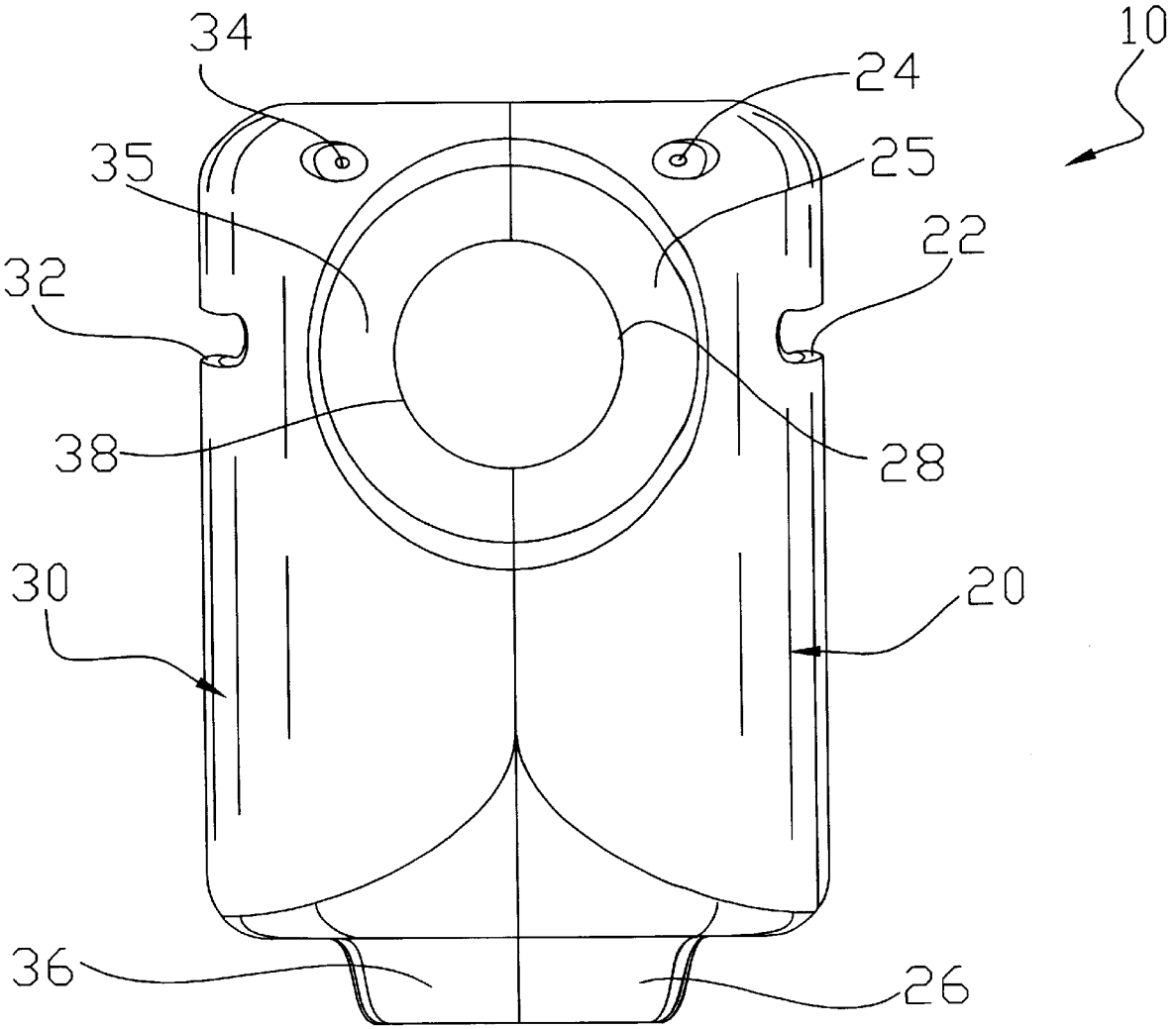
FIG. 4 is a front view of the present invention.
Figure 5:
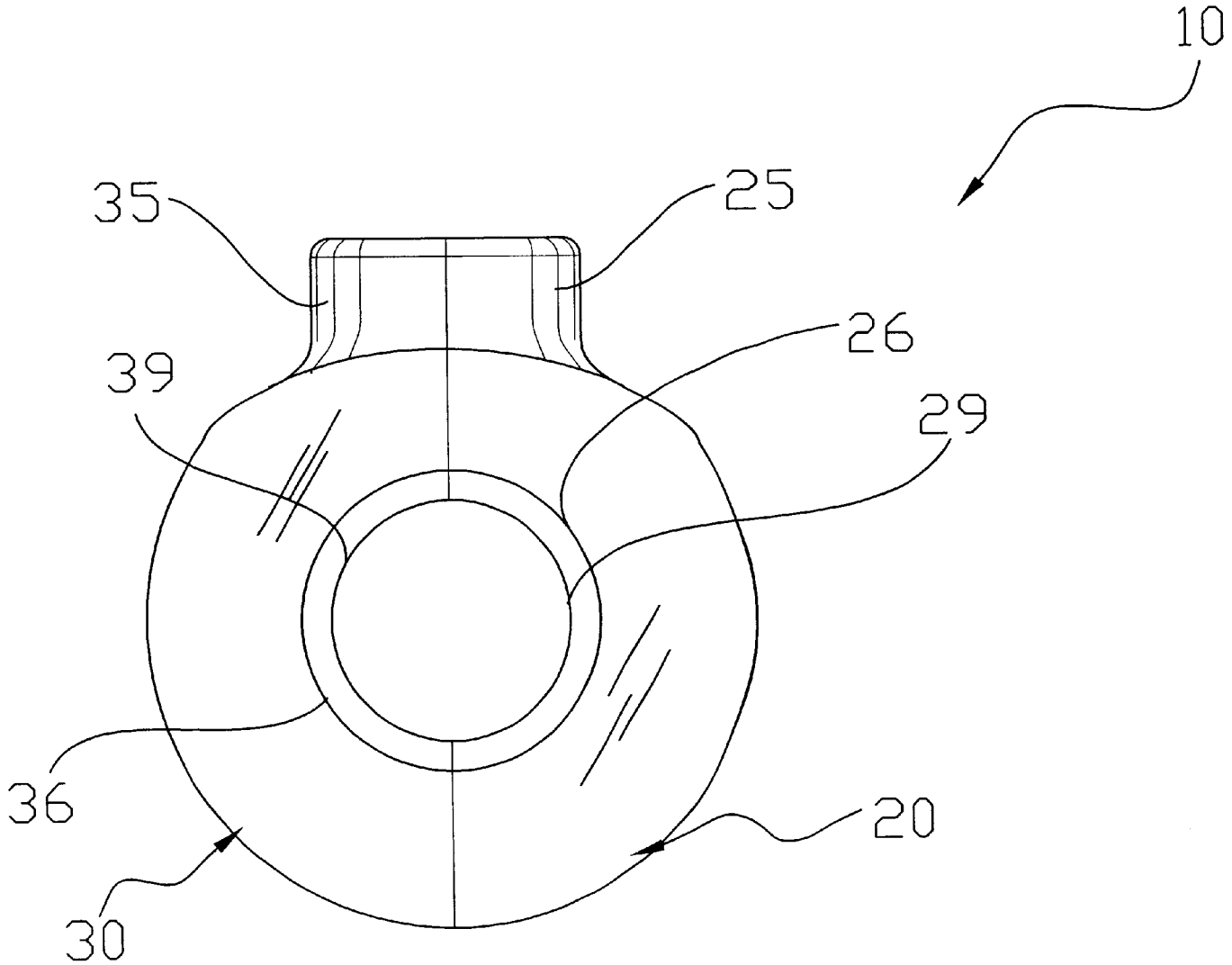
FIG. 5 is a bottom view of the present invention.

As shown in FIGS. 1, 4 and 5 of the drawings, a first upper neck 25 extends from the upper portion of the first cover 20. The first upper neck 25 is preferably a tapered structure as best shown in FIG. 5 of the drawings. The first upper neck 25 includes a first side cutout 28 as shown in FIGS. 1 and 4 of the drawings. The first side cutout 28 preferably has a semi-circular shape as best illustrated in FIG. 4 of the drawings.

Figure 3:
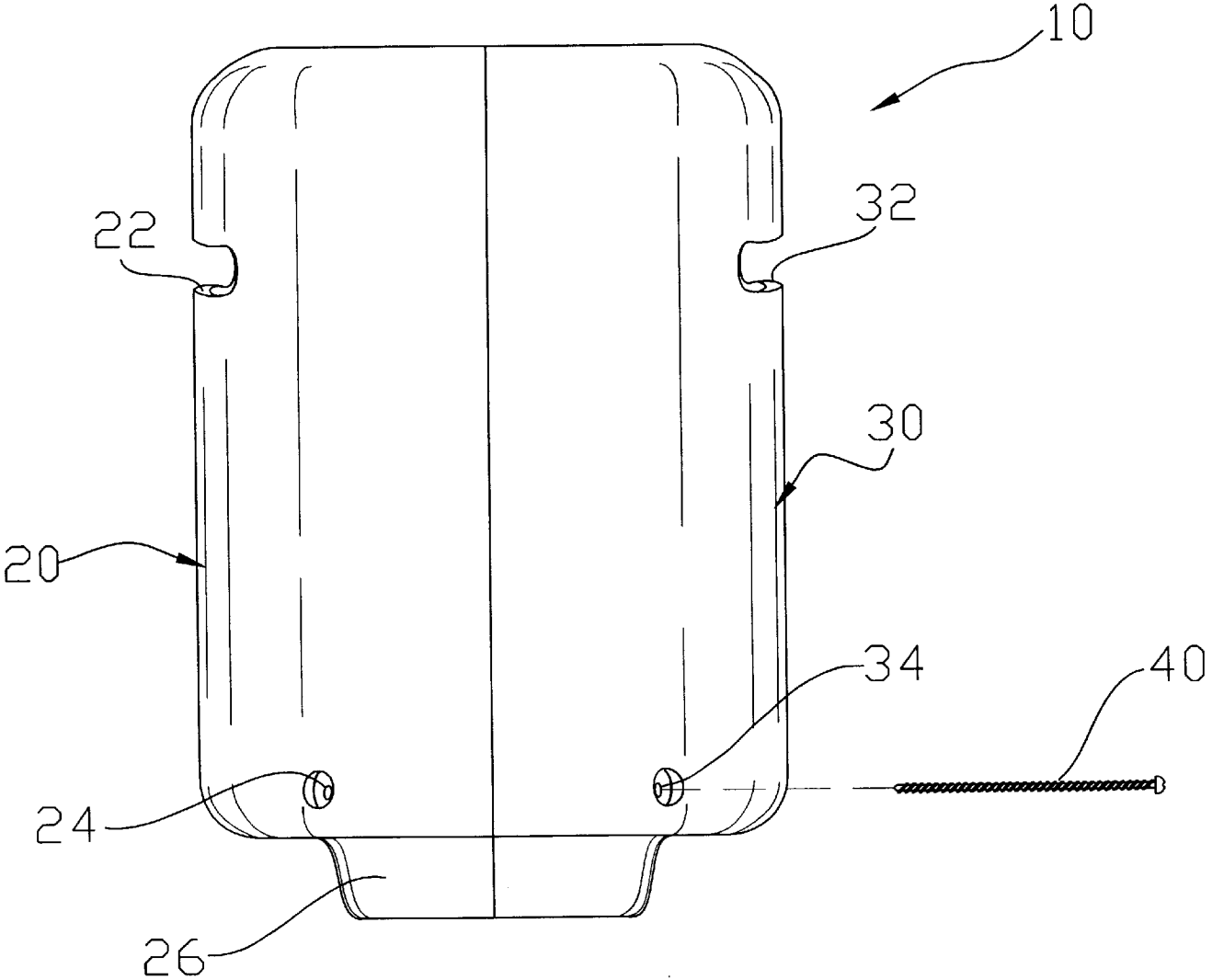
FIG. 3 is a rear view of the present invention.

As shown in FIGS. 1, 3, 4 and 5 of the drawings, a first lower neck 26 extends from the lower end of the first cover 20. The first lower neck 26 is preferably a tapered structure as best shown in FIGS. 3 and 4 of the drawings. The first lower neck 26 includes a first lower cutout 29 as shown in FIG. 5 of the drawings. The first lower cutout 29 preferably has a semi-circular shapes as best illustrated in FIG. 5 of the drawings.

Figure 2:
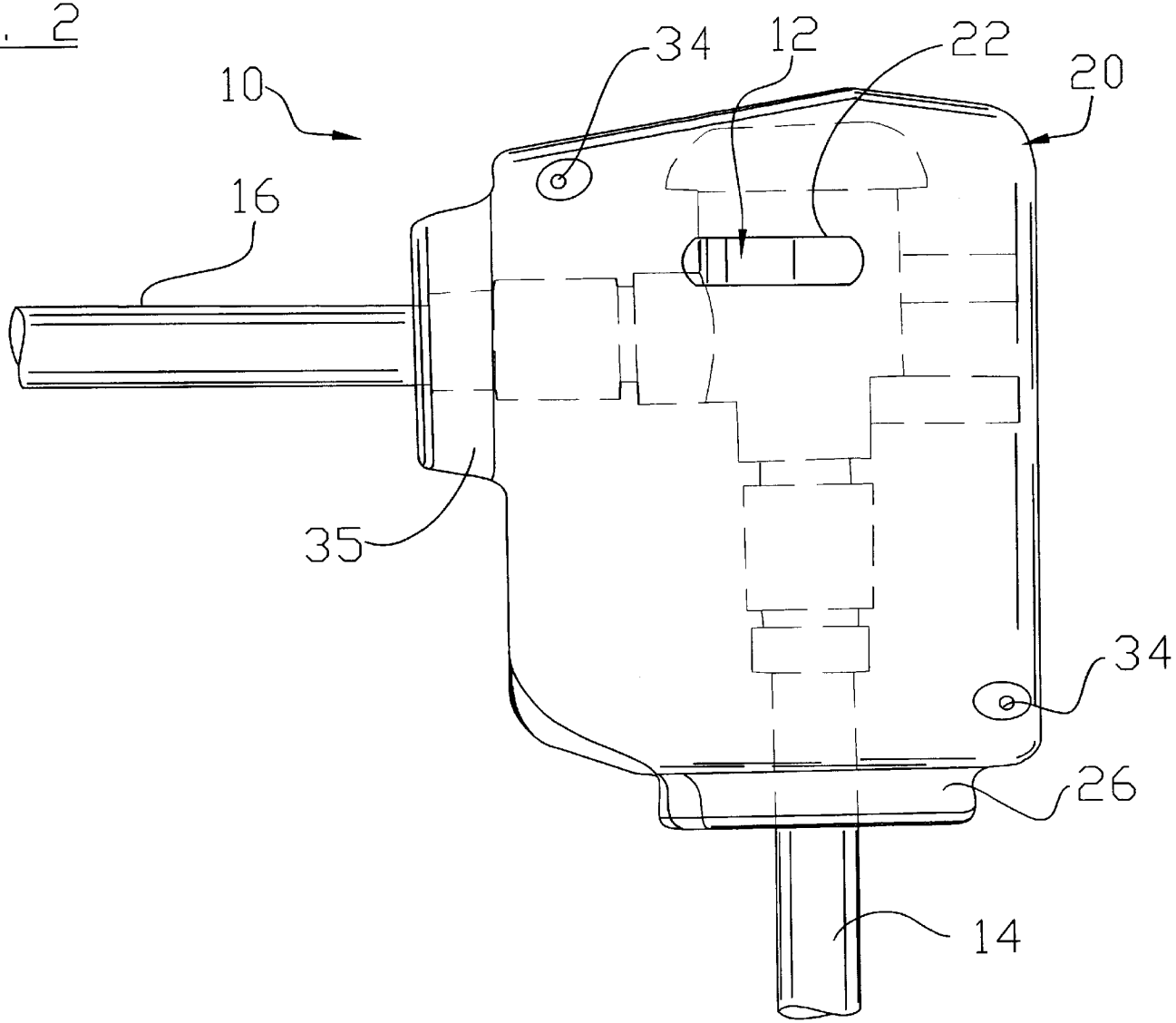
FIG. 2 is a left side view of the present invention positioned about a pressure vacuum breaker.

As shown in FIGS. 1, 3 and 4 of the drawings, the first cover 20 includes a plurality of first apertures 24 that are preferably recessed within the first cover 20. The first apertures 24 mate with apertures within the second cover 30 for threadably receiving a conventional fastener 40 such as but not limited to a screw. The first apertures 24 are preferably aligned with at least one first aperture 24 within the upper portion of the first cover 20 and at least one first aperture 24 within the lower portion of the first cover 20 as best illustrated in FIG. 2 of the drawings.

As best shown in FIG. 1 of the drawings, the second cover 30 is formed into a shell structure for conforming to half of the shape of the vacuum breaker 12. The second cover 30 is formed to mirror the first cover 20 as illustrated in FIGS. 1 through 5 of the drawings. The second cover 30 has a second lip 31 that mates with the first lip 21 of the first cover 20 as shown in FIG. 1 of the drawings. As further shown in FIG. 1 of the drawings, the second lip 31 preferably extends underneath the first lip 21 of the first cover 20 to provide a consistent seal between the covers 20, 30. The second cover 30 further includes at least one second vent 32 for allowing the vacuum breaker 12 to properly function and breath. The second vent 32 is preferably positioned within an upper portion of the second cover 30 on the side portion thereof.

As shown in FIGS. 1, 4 and 5 of the drawings, a second upper neck 35 extends from the upper portion of the second cover 30 corresponding to the first upper neck 25 of the first cover 20. The second upper neck 35 is preferably a tapered structure as best shown in FIG. 5 of the drawings. The second upper neck 35 includes a second side cutout 38 as shown in FIGS. 1 and 4 of the drawings. The second side cutout 38 preferably has a semi-circular shape that corresponds to the first side cutout 28 as best illustrated in FIG. 4 of the drawings.

As shown in FIGS. 1, 3, 4 and 5 of the drawings, a second lower neck 36 extends from the lower end of the second cover 30. The second lower neck 36 is preferably a tapered structure as best shown in FIGS. 3 and 4 of the drawings. The second lower neck 36 includes a second lower cutout 39 as shown in FIG. 5 of the drawings. The second lower cutout 39 preferably has a semi-circular shape as best illustrated in FIG. 5 of the drawings.

As shown in FIGS. 1, 3 and 4 of the drawings, the second cover 30 includes a plurality of second apertures 34 that are preferably recessed within the second cover 30. The second apertures 34 mate with first apertures 24 within the first cover 20 for threadably receiving a conventional fastener 40 such as but not limited to a screw. As shown in FIGS. 1, 3 and 4 of the apertures 24, 34 are positioned near the outer perimeters of the covers 20, 30 to provide securing of the covers 20, 30 together.

In use, the user may paint the exterior surfaces of the covers 20, 30 prior to installation to correspond to the color of an adjacent building structure. The user then positions the first cover 20 and second cover 30 adjacent the side of the vacuum breaker 12 as shown in FIG. 1 of the drawings. The user then mates the lips 21, 31 of the covers 20, 30 with one another thereby maintaining the covers 20, 30 positioned about the vacuum breaker 12, lower pipe 14 and upper pipe 16 as shown in FIG. 2 of the drawings. The user then inserts fasteners 40 into the apertures 24, 34 and thereafter secures the covers 20, 30 to one another with the fasteners 40. If the user requires access to the vacuum breaker 12, the user simply removes each fastener 40 from the apertures 24, 34 and then removes the covers 20, 30 from about the vacuum breaker 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pressure vacuum breaker cover assembly, comprising:

a first cover formed for fitting about a vacuum breaker;

a second cover formed for fitting about said vacuum breaker in an opposing position with respect to said first cover; and a means for securing said covers;

wherein said covers each include an upper neck having a side cutout for fitting about an upper pipe of said vacuum breaker extending horizontally from said vacuum breaker;

wherein said covers each include a lower neck having a lower cutout for fitting about a lower pipe of said vacuum breaker, wherein said lower pipe extends from said vacuum breaker downwardly and substantially traverse with respect to said upper pipe;

wherein said each side cutout and each said lower cutout have a semi-circular shape;

wherein each said upper neck and each said lower neck are tapered;

wherein said means for securing said covers is comprised of a plurality of apertures extending within said covers that threadably receive a plurality of threaded fasteners;

wherein said plurality of apertures are aligned within said first cover and said second cover for allowing connecting of said covers to one another;

wherein said plurality of apertures are recessed within said covers;

wherein said first cover includes a first lip and said second cover includes a second lip, wherein said first lip mates with said second lip forming a seal between said first cover and said second cover.

2. The pressure vacuum breaker cover assembly of claim 1, wherein said covers are comprised of a foam material.

3. The pressure vacuum breaker cover assembly of claim 1, including at least one vent within said covers.

4. A pressure vacuum breaker cover assembly, comprising:

a first cover formed for fitting about a vacuum breaker;

a second cover formed for fitting about said vacuum breaker in an opposing position with respect to said first cover;

a plurality of apertures extending within said covers that threadably receive a plurality of threaded fasteners, wherein said plurality of apertures are aligned within said first cover and said second cover for allowing connecting of said covers to one another;

wherein said first cover includes a first lip and said second cover includes a second lip, wherein said first lip slidably mates in a juxtaposed position with said second lip forming a seal between said first cover and said second cover;

wherein said covers each include an upper neck having a side cutout for fitting about an upper pipe of said vacuum breaker extending horizontally from said vacuum breaker; and wherein said covers each include a lower neck having a lower cutout for fitting about a lower pipe of said vacuum breaker, wherein said lower pipe extends from said vacuum breaker downwardly and substantially traverse with respect to said upper pipe.

5. The pressure vacuum breaker cover assembly of claim 4, wherein said covers are comprised of a foam material.

6. The pressure vacuum breaker cover assembly of claim 4, including at least one vent within said covers.

* * * * *